US011859451B2

(12) United States Patent
Plunkett et al.

(10) Patent No.: US 11,859,451 B2
(45) Date of Patent: Jan. 2, 2024

(54) ONE-TIME ACTIVATION OR DEACTIVATION OF ROLLING DOCC

(71) Applicant: Halliburton Energy Services, Inc., Houston, TX (US)

(72) Inventors: Kelley Leigh Plunkett, The Woodlands, TX (US); Kevin Clark, Willis, TX (US); Van Jordan Brackin, Spring, TX (US); Chris Propes, Montgomery, TX (US); Rob Arfele, Montgomery, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 96 days.

(21) Appl. No.: 17/502,134

(22) Filed: Oct. 15, 2021

(65) Prior Publication Data

US 2023/0117439 A1 Apr. 20, 2023

(51) Int. Cl.
*E21B 10/62* (2006.01)
*E21B 10/42* (2006.01)

(52) U.S. Cl.
CPC ..... *E21B 10/62* (2013.01); *E21B 10/42* (2013.01)

(58) Field of Classification Search
CPC ..... E21B 10/62; E21B 10/42; E21B 10/43; E21B 10/627; E21B 10/633; E21B 10/54; E21B 10/55
See application file for complete search history.

(56) References Cited

U.S. PATENT DOCUMENTS

| | | | | |
|---|---|---|---|---|
| 6,142,250 | A * | 11/2000 | Griffin | E21B 10/325 175/426 |
| 8,141,665 | B2 | 3/2012 | Ganz | |
| 9,103,171 | B2 | 8/2015 | Hanford | |
| 9,255,449 | B2 * | 2/2016 | Schwefe | E21B 10/62 |
| 9,976,353 | B2 | 5/2018 | Hinz et al. | |
| 10,174,563 | B2 | 1/2019 | Thomas | |
| 10,214,968 | B2 | 2/2019 | Evans et al. | |
| 10,487,589 | B2 | 11/2019 | Yu et al. | |
| 10,494,876 | B2 | 12/2019 | Mayer et al. | |
| 11,015,395 | B2 | 5/2021 | Grosz | |
| 11,261,669 | B1 * | 3/2022 | Alzaki | E21B 10/633 |
| 2012/0318580 | A1 * | 12/2012 | Oesterberg | E21B 10/60 175/428 |

(Continued)

FOREIGN PATENT DOCUMENTS

| | | |
|---|---|---|
| WO | 2016057076 | 4/2016 |
| WO | 2020018780 | 1/2020 |

OTHER PUBLICATIONS

Baker Hughes, TerrAdapt adaptive drill bit, 2021.
Halliburton, Cruzer Depth-of-Cut Rolling Element, H012380, Nov. 2016.

*Primary Examiner* — Blake Michener
(74) *Attorney, Agent, or Firm* — Michael Jenney; C. Tumey Law Group PLLC

(57) ABSTRACT

A depth of cut control (DOCC) assembly includes a DOCC element positioned in a retainer pocket along a drill bit blade to limit a depth of cut of one or more fixed cutters. A retention member initially retains the DOCC element within the retainer pocket at a first exposure position. The retention member is configured to release the DOCC element downhole to allow one-way movement of the DOCC element to a second exposure position.

19 Claims, 8 Drawing Sheets

(56) References Cited

U.S. PATENT DOCUMENTS

| | | | | |
|---|---|---|---|---|
| 2014/0027180 | A1* | 1/2014 | Schwefe | E21B 7/064 175/57 |
| 2014/0174827 | A1* | 6/2014 | Schen | E21B 10/62 175/428 |
| 2014/0332271 | A1* | 11/2014 | Do | E21B 10/42 175/57 |
| 2014/0332283 | A1* | 11/2014 | Do | E21B 10/627 51/293 |
| 2015/0152723 | A1* | 6/2015 | Hay | E21B 12/00 175/17 |
| 2016/0153243 | A1* | 6/2016 | Hinz | E21B 10/633 175/413 |
| 2017/0159369 | A1* | 6/2017 | Evans | E21B 7/00 |
| 2017/0204677 | A1* | 7/2017 | Yu | E21B 10/55 |
| 2017/0275951 | A1* | 9/2017 | Thomas | E21B 10/42 |
| 2018/0030786 | A1* | 2/2018 | Dunbar | E21B 10/42 |
| 2019/0040691 | A1* | 2/2019 | Mayer | E21B 12/00 |
| 2019/0106944 | A1 | 4/2019 | Welch | |
| 2020/0024906 | A1 | 1/2020 | Etebu et al. | |
| 2020/0399961 | A1 | 12/2020 | Plunkett et al. | |
| 2021/0254410 | A1* | 8/2021 | Maouche | E21B 10/43 |
| 2023/0117681 | A1* | 4/2023 | Clark | E21B 17/1092 175/263 |
| 2023/0184042 | A1* | 6/2023 | Clark | E21B 10/633 175/327 |

* cited by examiner

ONE-TIME ACTIVATION OR DEACTIVATION OF ROLLING DOCC

BACKGROUND

Wellbores are commonly drilled using rotary drill bits at the end of a drill string. One common type of drill bit is a fixed cutter drill bit having a plurality of cutters secured at fixed location and cutting orientations to a bit body. Drilling generally requires applying a downward force on the drill bit to engage the cutters with the formation, in combination with rotation of the drill bit to cut the formation. However, contact between the cutting elements and downhole formations generates friction and other forces that can result in prematurely worn or damaged cutting elements and scrapped bits. Therefore, depth-of-cut control (DOCC) elements are sometimes secured to the bit body to limit a depth of cut of the cutters, such as to prevent over-engagement of the cutting elements with the formation.

BRIEF DESCRIPTION OF THE DRAWINGS

These drawings illustrate certain aspects of some of the embodiments of the present disclosure and should not be used to limit or define the method.

DETAILED DESCRIPTION

Disclosed are depth of cut control (DOCC) assemblies for a drill bit that have moveable DOCC elements to change their exposure and the corresponding engagement of cutters during drilling. Changing the engagement of the DOCC elements may change the bit aggressiveness. For example, it may be desirable to have a less aggressive bit in some applications where there is more need for directional control or that otherwise may entail slower drilling, and then transition to a more aggressive bit by backing off the DOCC elements where more weight on bit is used to drill faster. Rather than moving back and forth between exposure positions, the DOCC elements in at least some embodiments are activated or deactivated once during drilling. This serves various drilling applications for which it is desirable for cutters to have one depth of engagement during part of the drill bit run, and another depth of engagement in a subsequent part of the drill bit run. For example, in forming a multilateral wellbore, DOCC elements may be set with a higher initial exposure (relative to the cutter profile) for curve runs to prevent the bit from over-engaging, but transition to a lower exposure once in the lateral wellbore, so as not limit rate of penetration (ROP). Such one-time activation or de-activation and one-way change in exposure height may reduce costs and increase reliability.

Numerous example embodiments are given that provide one-way movement of DOCC elements from a first exposure position to a second exposure position. The examples discussed primarily use rolling DOCC elements, but non-rolling DOCC elements may also be used. One or more embodiments include a DOCC element rotatably positioned in a retainer pocket along the blade to limit a depth of cut of one of the fixed cutters. A retention member initially retains the DOCC element within the retainer pocket at a first exposure position. The retention member is configured to release the DOCC element downhole to allow one-way movement of the DOCC element to a second exposure position. The retention member may comprise, in some examples, one or more burst discs, pins, shelves, bearing elements, or caps that initially retain the DOCC element in the first exposure position. The retainer elements may be configured to yield, fail, displace, and/or disintegrate, such as by melting, liquifying, dissolving, abrading, or wearing, in response to a threshold force, pressure, or temperature, or contact with a solvent or abrasive fluid, as non-limiting examples. The retainer elements may also comprise a plurality of retainer elements corresponding to different exposure positions so that the DOCC element may successively move from one exposure position to the next during drilling. These and other examples are further understood with respect to the figures discussed below.

Figure 1:
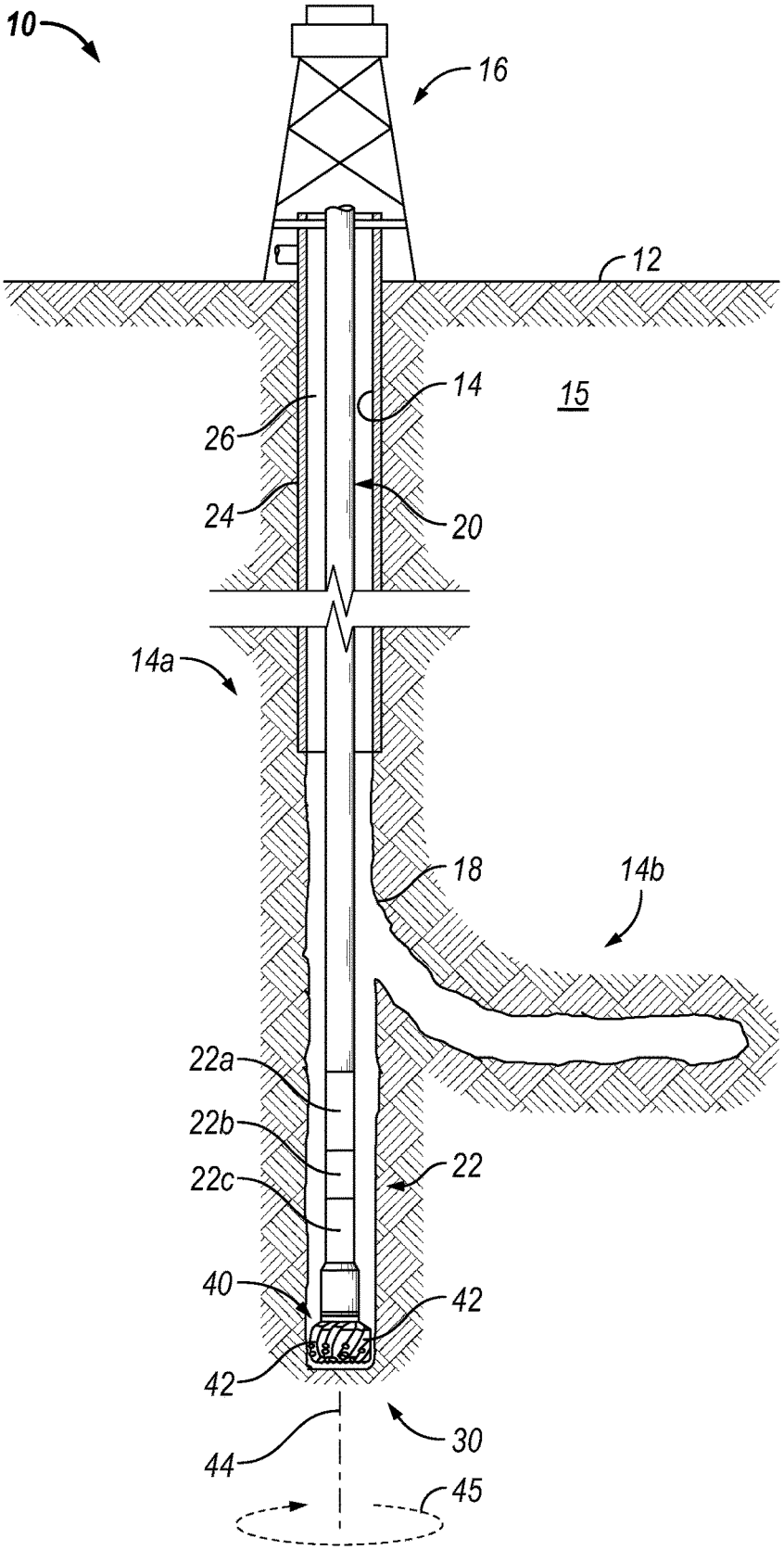
FIG. 1 is an elevation view of an example drilling system in which a drill bit according to aspects of this disclosure may be used to drill a wellbore.

FIG. 1 is an elevation view of an example drilling system 10 in which a drill bit 40 according to aspects of this disclosure may be used to drill a wellbore 14. Drilling system 10 may be assembled at a well site with drilling equipment such as a rotary table, drilling fluid pumps and drilling fluid tanks at an above ground location (i.e., at the surface) 12. For example, a drilling rig 16 may be provided with various features associated with terrestrial drilling operations with a land drilling rig. However, teachings of the present disclosure may be applied in offshore drilling operations, e.g., operations with drilling equipment located on offshore platforms, drill ships, semi-submersibles and drilling barges. The drilling system 10 includes a drill string 20 including a bottom hole assembly (BHA) 22 with the drill bit 40 secured at a lower end for forming a wellbore 14 in an earthen formation 15 below the surface 12. The wellbore 14 may follow any given wellbore path to reach one or more target zones in the formation 15. The wellbore 14 in this example happens to be a multilateral wellbore that includes a generally vertical main bore 14*a* and at least one wellbore branch 14*b* that deviates from vertical. The wellbore branch 14*b* may be formed, for example, using a whipstock assembly at a multilateral junction 18. Various directional drilling techniques may also be used to control the direction of drilling of the wellbore(s) in an effort to reach one or more target zones.

The BHA 22 may include the drill bit 40 and any number of other BHA components, schematically depicted at 22*a*, 22*b* and 22*c*, coupled to the drill string 20 above the drill bit 40. The BHA components 22*a*, 22*b* and 22*c* may include, but are not limited to, drill collars, rotary steering tools, directional drilling tools, downhole drilling motors, reamers, hole enlargers, stabilizers etc. The number and types of BHA components 22*a*, 22*b* and 22*c* may depend on anticipated downhole drilling conditions and the type of wellbore 14 that will be formed by drill string 20 and rotary drill bit 40. The BHA 22 may also include various types of well logging tools (not expressly shown) and other downhole tools associated with directional drilling of a wellbore. Examples of logging tools and/or directional drilling tools may include, but are not limited to, acoustic, neutron, gamma ray, density, photoelectric, nuclear magnetic resonance, rotary steering tools and/or any other commercially available well tool. The BHA components 22*a*, 22*b* and 22*c* may also include a downhole motor capable of rotating the drill bit 40 with respect to an upper portion of the drill string 20. The wellbore 14 may be drilled by engaging the drill bit 40 with the formation while rotating the drill bit 40, such as by rotating the entire drill string 20 from the surface and/or by rotating the drill bit 40 with the mud motor.

The wellbore 14 may be defined in part by a casing string 24 that may be cemented in place, extending along at least a portion of the wellbore 14. Portions of the wellbore 14 that do not include casing string 24 may be described as "open hole." Various types of drilling fluid, or "mud," may be pumped from the surface 12 through drill string 20. The drilling fluid may be expelled from the drill string 20 through nozzles passing through the drill bit 40. The drilling fluid may be circulated back to surface 12 through an annulus 26 defined between an outside diameter of the drill string 20 and a surrounding structure. Along an open hole portion, the annulus 26 is defined between the drill string 20 and an inside diameter of the wellbore 14*a*. The inside diameter may be referred to as the sidewall of the wellbore 14*a*. Along a cased portion, the annulus 26 may be defined between the drill string 20 and an inside diameter of the casing string 24.

The drill bit 40 may rotate with respect to a bit rotational axis 44 in a direction defined by directional arrow 45. As the drill bit 40 is rotated, the cutters, which may include fixed cutters and/or rolling cutters, may engage and cut the formation. As discussed below, a plurality of DOCC elements may be provided on the drill bit 40 to limit the engagement of the cutters. The cutters may cut by scraping, gouging, shearing, or otherwise disintegrating the formations surrounding wellbores 14. The resulting cuttings may be continuously removed by the drilling fluid circulated through the drill string 20 back to the surface 12, where the cuttings may be removed from the drilling fluid by surface equipment.

Figure 2:
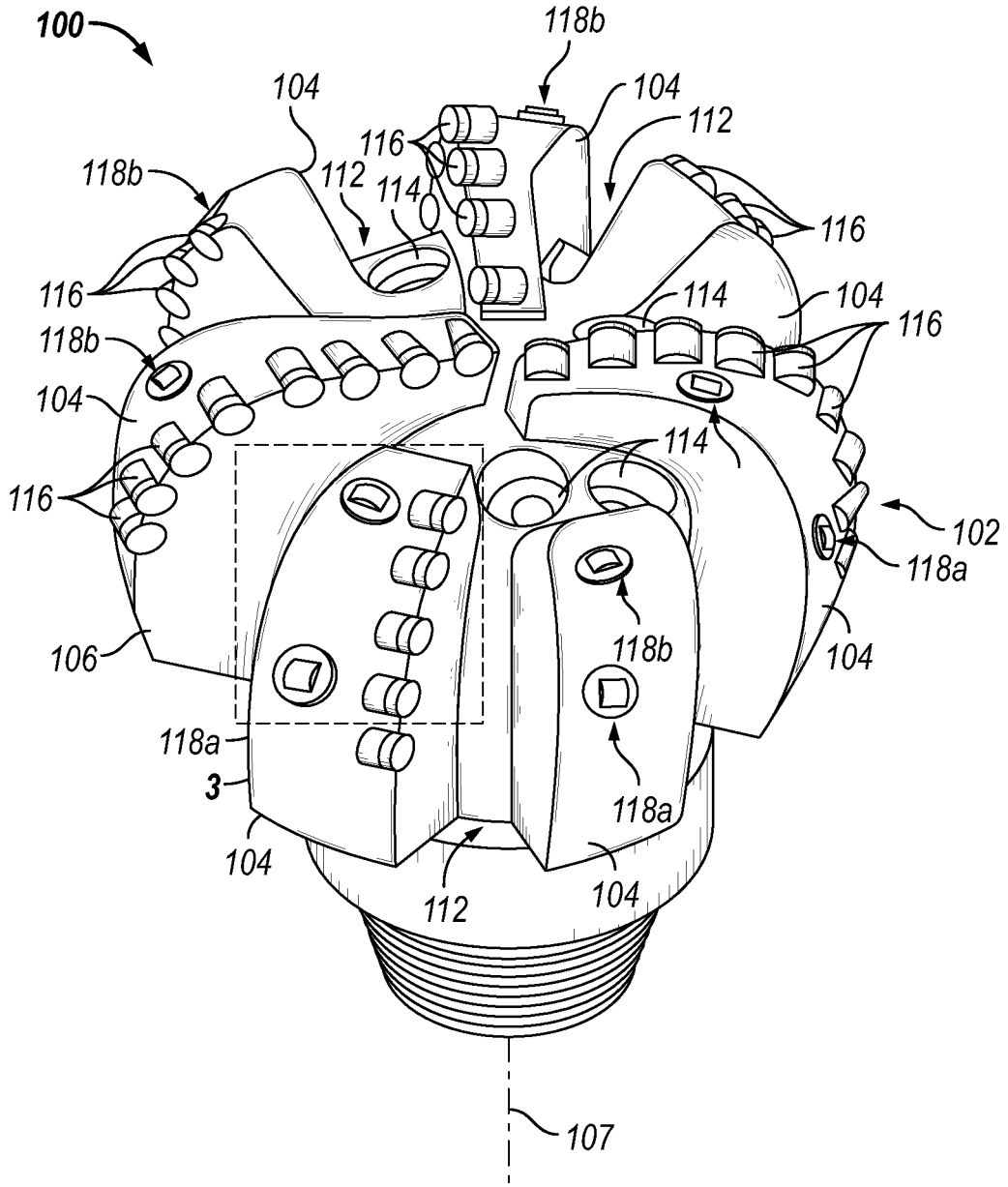
FIG. 2 is an isometric view of a drill bit according to aspects of the disclosure, as an example configuration of the drill bit generally depicted in FIG. 1.

FIG. 2 is an isometric view of a drill bit 100 in accordance with aspects of the present disclosure, as an example configuration of the drill bit 40 generally depicted in FIG. 1. The drill bit 100 includes a bit body 102, which may be formed, for example, from a steel or a metal matrix composite. The bit body 102 includes radially and longitudinally extending blades 104. Junk slots 112 are defined between adjacent blades 104. A plurality of nozzles or ports 114 can be arranged within junk slots 112 for ejecting drilling fluid that cools drill bit 100 and otherwise flushes away cuttings and debris generated while drilling. When incorporated into a drill string (e.g., FIG. 1), the bit body 102 generally rotates about a longitudinal drill bit axis 107 with leading faces 106 of the blades 104 facing the direction of rotation.

The drill bit 100 may be categorized as a fixed cutter drill bit, in that its cutting structure comprises a plurality of cutters 116 secured at fixed cutting orientations to drill into the earthen formation under an applied weight-on-bit (WOB). The plurality of fixed cutters 116 may be secured to the blades 104 within corresponding cutter pockets sized and shaped to receive the fixed cutters 116. Each cutter 116, in this example, comprises a fixed cutter secured within its corresponding cutter pocket via brazing, threading, shrink-fitting, press-fitting, snap rings, or any combination thereof. The fixed cutting orientation at which the fixed cutters 116 are held in blades 104 and respective cutter pockets may comprise predetermined angular orientations and radial locations, and may present the fixed cutters 116 with a desired back rake angle against the formation being drilled. As the drill bit 100 is rotated on the drill string about the bit axis 107, the fixed cutters 116 sweep three dimensional (3D) cutting profiles. During drilling, the fixed cutters 116 are driven through the rock by the combined forces of the weight-on-bit and the torque applied to the drill bit 100. During drilling, the fixed cutters 116 may experience a variety of forces, such as drag forces, axial forces, reactive moment forces, or the like, due to the interaction with the underlying formation being drilled as drill bit 100 rotates.

Each fixed cutter 116 may include a generally cylindrical substrate made of a hard material, such as tungsten carbide (WC), and a cutting element secured to the substrate. The working surface of the cutting element is typically flat or planar, but may also exhibit a curved or otherwise non-planar exposed surface that defines a cutting edge oriented for cutting into an earthen formation. The cutting element may include one or more layers of an ultra-hard material, such as polycrystalline diamond (PCD), polycrystalline cubic boron nitride, impregnated diamond, etc., which generally forms a cutting edge and the working surface for each fixed cutter 116. In some cases, a PCD cutting element may be formed and bonded together with the substrate in a high-temperature, high-pressure press cycle, with the resulting cutter referred to as a polycrystalline diamond compact (PDC). When using polycrystalline diamond as the ultra-hard material, fixed cutter 116 may be referred to as a polycrystalline diamond compact cutter or PDC cutter, and drill bits made using such PDC fixed cutters 116 are generally known as PDC bits.

The drill bit 100 also has rolling element assemblies 118*a*, 118*b* secured to the bit body 102. The orientation of a rolling element in each rolling element assembly 118*a*, 118*b* determines, at least in part, whether the rolling element operates as a cutter, a rolling depth of cut control (DOCC) element, or a hybrid of both. In this example the rolling cutter assemblies 118*a* are configured as rolling cutters and the rolling cutter assemblies 118*b* are configured as rolling depth of cut controllers (rolling DOCC). The rolling cutters 118*a* include rolling elements that, like the fixed cutters 116, have cutting edges oriented for cutting into an earthen formation while drilling. In the design of the drill bit 100, the desired back rake and side rake angles may be selected and otherwise optimized with respect to fixed cutters 116 and/or rolling cutters 118*a*. The rolling depth of cut controllers 118*b* include rolling DOCC elements positioned to instead roll against the formation, limiting a depth of cut of one or more of the fixed cutters 116 and/or rolling cutters 118*a*. Rolling DOCC elements may prove advantageous in allowing for additional weight-on-bit to enhance directional drilling applications without over engagement of the fixed cutters 116. Effective depth of cut control also limits fluctuations in torque and minimizes stick-slip, which can cause damage to fixed cutters 116.

At least some of the rolling element assemblies 118*a*, 118*b* have rolling elements whose exposure positions (e.g., exposure height of a rolling element relative to the cutting profiles of adjacent cutters whose depth is limited thereby) may change during drilling, which may change how aggressively the drill bit 100 drills. Those rolling elements are initially retained at a first exposure position, such as while drilling a first portion of the wellbore, and then released downhole to allow movement of the DOCC element to a second exposure position. The movement from the first exposure position to the second exposure position may be one-way, so that at some point during drilling the drill bit may become more aggressive or the drill bit may become less aggressive. For example, the DOCC elements may initially be set with a higher exposure (i.e., greater engagement) for curve applications to prevent the cutters from over-engaging, but transition to a lower exposure in a lateral wellbore so as not limit rate of penetration (ROP).

Several example configurations are discussed below and conceptually illustrated in subsequent figures that enable this one-way movement from a first exposure position to a second exposure position. In some examples, the DOCC elements move inwardly to achieve a one-time deactivation, thereby providing a less aggressive, shallower initial depth of cut that subsequently increases for more aggressive drilling. In other examples, the DOCC elements may instead be configured to move outwardly for a one-time activation during drilling, thereby providing a more aggressive drilling initially, followed by a shallower depth of cut later in the drilling.

Figure 3:
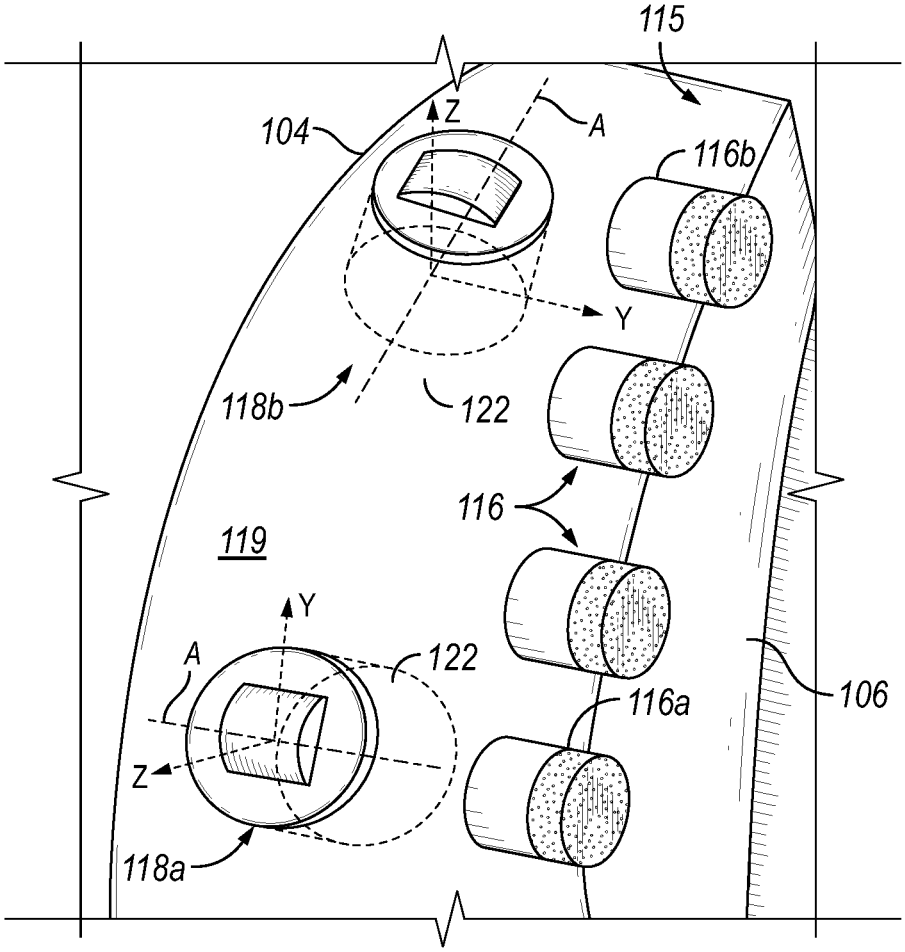
FIG. 3 is an enlarged portion of a blade indicated by the dashed box shown in FIG. 2 including one example of a rolling cutter and one example of a rolling depth of cut controller.

FIG. 3 is an enlarged portion of one of the blades 104 indicated by the dashed box shown in FIG. 2, including one example of a rolling cutter 118*a* and one example of a rolling DOCC 118*b*. Each rolling element assembly 118*a*, 118*b* includes a rolling element 122 rotatably secured on the blade 104. Exposed portions of the rolling elements 122 are illustrated in solid linetype, while portions of rolling elements 122 that are seated within corresponding retainer pockets illustrated in dashed linetype. The pockets may be defined by the blade 104 itself or by a retainer housing embedded in the blade 104.

Each rolling element 122 has a rotational axis A, a Z-axis that is perpendicular to the blade profile, and a Y-axis that is orthogonal to both the rotational and Z-axes. As shown, the exposed portion of each rolling element 122 may be constant with respect to the position along the rotational axis A of the rolling element, in either the DOCC or the cutter orientation.

A rolling element may be considered a rolling cutter or a rolling DOCC element depending on its position and orientation. If, for example, the rotational axis A of a rolling element 122 is substantially parallel to a tangent to outer surface 119 of the blade profile, that rolling element assembly 118*b* may generally operate as a rolling DOCC element. For example, if the rotational axis A of the rolling element 122 passes through or lies on a plane that passes through the longitudinal bit axis 107 (FIG. 2) of the drill bit 100 (FIG. 2), then the rolling element assembly 118*b* may substantially operate as a rolling DOCC element. If, however, the rotational axis A of a rolling element 122 is substantially perpendicular to leading face 106 of the blade 104, then that rolling element assembly 118*a* may substantially operate as a rolling cutting element. For example, if the rotational axis A of a rolling element 122 is perpendicular to or lies on a plane that is perpendicular to a plane passing through the longitudinal axis 107 (FIG. 2) of the drill bit 100 (FIG. 2), then the rolling element assembly 118*a* may substantially operate as a rolling cutting element.

Another design consideration is the placement of the rolling element assemblies 118*a*, 118*b* relative to the fixed cutters 116. In this example, the fixed cutters 116 form part of a primary cutting structure 115, and the rolling cutter 118*a* is positioned on the blade 104 as a backup or secondary cutter to the fixed cutter 116*a* most directly ahead of the rolling cutter 118, towards the leading face 106 of the same blade 104. Although not required, the rolling cutter 118*a* may be positioned directly behind the primary cutter 116*a*. Alternatively, the rolling cutter 118*a* may be staggered laterally (in the Y direction) with respect to that primary cutter 116*a* so their respective cutting profiles only partially overlap. As another example, the placement of the rolling cutter 118*a* on the blade 104 may instead be selected relative to the cutter on another blade (not shown), such as to align the path of the rolling cutter 118*a* behind the path of the cutter on the other blade as they rotate about the bit axis.

Placement of the rolling DOCC 118*b* may be selected to limit the depth of cut of one or more of the fixed cutters 116. Typically, the rolling DOCC 118*b* would limit the depth of cut of an adjacent or nearest fixed cutter, and typically (although not necessarily) on the same blade 104. Although the rolling DOCC 118*b* could at least indirectly affect the depth of cut of other cutters, other fixed or rolling DOCCs could be positioned nearer to such other cutters to more directly affect their respective depth of cut. In this example, the rolling DOCC 118*b* is placed to limit the depth of cut of the fixed cutter 116*b* most directly ahead of the rolling DOCC 118*b*.

Figure 4:
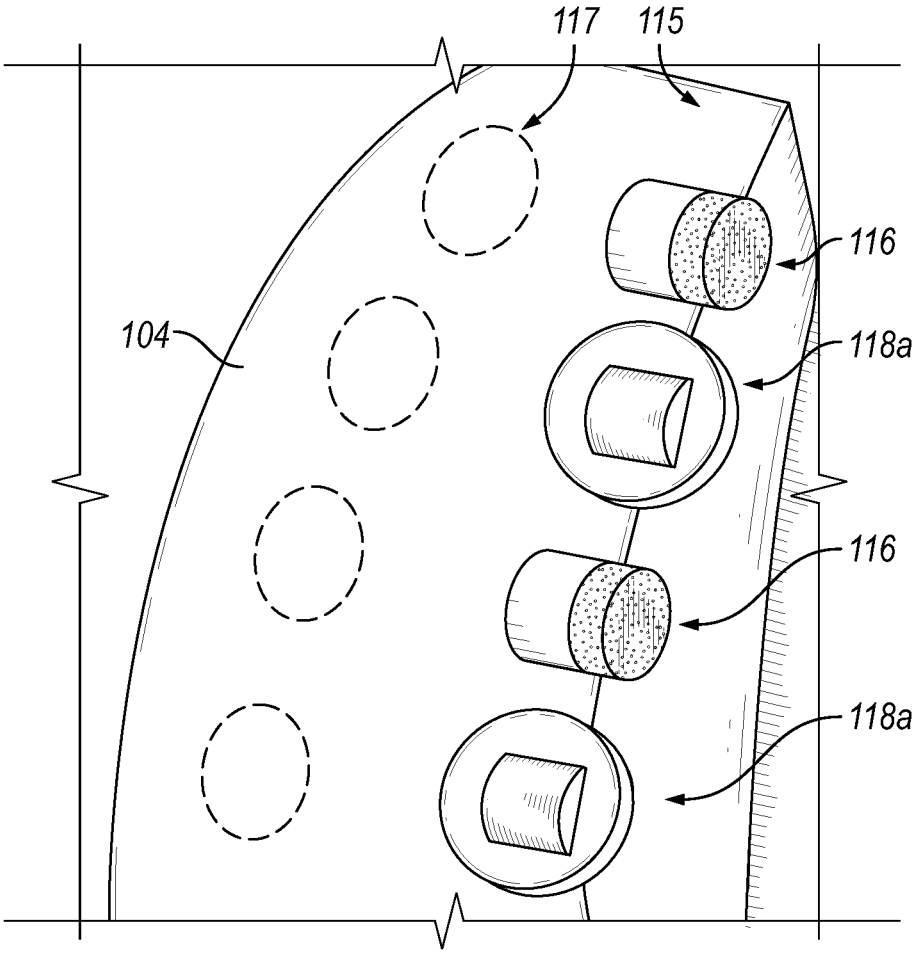
FIG. 4 is a portion of the blade according to another example configuration wherein rolling cutters and fixed cutters are both included as part of the primary cutting structure.

FIG. 4 is a portion of the blade 104 according to another example configuration wherein rolling cutters 118*a* and fixed cutters 116 are both included as part of the primary cutting structure. Other elements such as one or more fixed cutters, rolling cutters, and/or DOCC elements may be positioned in a secondary structure 117 such as at locations indicated by circles in dashed linetype. The rolling cutters 118*a* may be initially retained at a first exposure position and released downhole to a second exposure position (e.g., in a direction perpendicular to the page). The first exposure position of the rolling cutters 118*a* may be, for example, at substantially the same height as the fixed cutters 116. The second exposure position may be below the first exposure position (i.e., moved into the page). In that way, the rolling cutters 118*a* may initially be positioned to cut earthen formation with about the same exposure to the earthen formation as the fixed cutters 116 during drilling of a first wellbore portion. Then, the rolling cutters 118*a* may drop down for drilling a second wellbore portion. The rolling cutters 118*a*, which functioned as rolling cutters in the first exposure position may function at least partially as DOCC elements to the fixed cutters 116 in the second exposure position. That is, when the fixed cutters 116 engage the formation with sufficient depth that the rolling cutters 118*a* also engage the formation, contact of the rolling cutters 118*a* with the formation may resist further depth of engagement by the fixed cutters 116.

The following FIGS. 5 to 21 present a non-exhaustive number of examples of mechanical configurations of a depth of cut control (DOCC) element initially retained at a first exposure position that may be released to allow one-way movement of the DOCC element to a second exposure position. The release of the DOCC element may result from a failure or yielding of a retention member, such as due to plastic deformation, shearing, melting, dissolution, or wear of the retention member as a result of some downhole event. The downhole event may include, for example, an increase in a force, a pressure, or a temperature above some threshold, contact by a fluid that dissolves the retention member (solvent) or flow of an abrasive fluid over the retention member (abrasion), or the erosion of the retention member by the rolling element. In any of these examples, unless otherwise noted, the rolling element assemblies may be configured as a rolling DOCC element, a rolling cutter, or some hybrid thereof, based on the orientation and/or positioning such as described in the foregoing figures. In each of these examples, the DOCC element is depicted as a rolling DOCC element, but could alternatively be substituted with a non-rolling element. In each of these examples, a rolling element pocket is defined by a retainer housing disposed on the blade, but the rolling element pocket could alternatively be defined by the blade itself (without a structurally separate housing).

Figure 5:
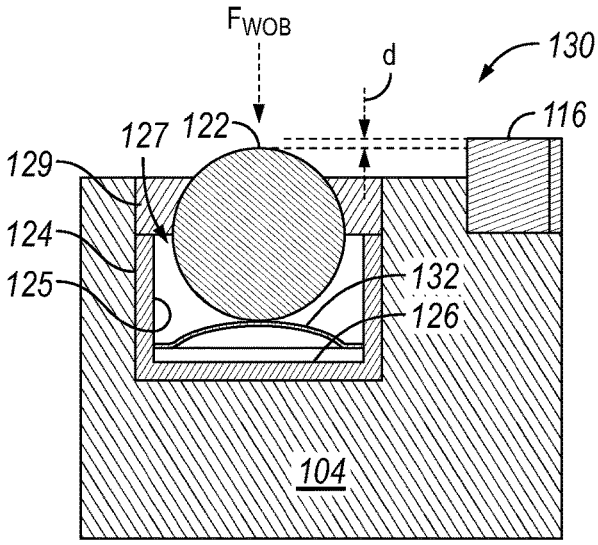
FIG. 5 is a rolling DOCC assembly with the rolling element initially retained in a first exposure position by a retention member comprising a burst disc.

FIG. 5 is a rolling DOCC assembly 130 with the rolling element 122 initially retained in a first exposure position by a retention member comprising a rupture disc (i.e., burst disc) 132. The rolling element 122, in at least the first exposure position, limits a depth of cut of at least one fixed cutter 116. The rolling element 122 is captured in a retainer housing 124 between a wall 125 and a floor 126 at least partially defining a retainer pocket 127 in which the rolling element 122 is captured. A top portion (i.e., cap) 129 of the housing may be positioned over the rolling element 122 during assembly to keep the rolling element secured in the blade 104. In an alternative configuration, the wall 125 may be incorporated with the top portion (cap) 129 of the housing so the cap 129 including the wall 125 may be positioned over the rolling element 122, in which case the wall 125 and the floor 126 may be structurally separate. In yet another embodiment, the rolling element 122, housing 124, and cap 129 may be pre-assembled as a housing assembly prior to installing the housing assembly on the blade 104. (In other embodiments and figures, it will be understood that some version of the cap 129 may also be present even if not explicitly called out.)

The retainer pocket 127 could alternatively be defined by the blade 104 itself, without including a distinct or structurally separate housing. The burst disc 132 is incorporated into the retainer housing 124, beneath the rolling element 122. This creates a gap between the burst disc 132 and the floor 126 of the retainer pocket 127. The burst disc 132 is rated to rupture (i.e., burst) at a specified loading, such as if the weight on bit loading ($F_{WOB}$) reaches a threshold.

The rolling element 122 limits depth of cut of a fixed cutter 116 in the first exposure position illustrated in FIG. 5. In the first exposure position, the top of the rolling element 122 sits slightly below the fixed cutter 116. A depth of engagement "d" of the fixed cutter 116 is related to this height difference between the fixed cutter 116 and the rolling element 122, where height may be as measured in the Z-direction with reference to FIG. 3. The bursting of the burst disc 132 will release the rolling element 122 to allow one-way movement of the rolling element 122 further down into the pocket 127 to a second exposure position. This movement from the first exposure position to the second exposure position will increase the depth of engagement of the fixed cutters 116, reducing or eliminating exposure of the rolling element 122 with the formation being drilled.

This movement of the rolling element 122 from the first exposure position to the second exposure position upon bursting of the burst disc 132 is considered one-way, in that the rolling element 122 is not biased back toward the first exposure position while drilling. For so long as $F_{WOB}$ is applied, the rolling element 122 may remain at the floor 126 of the retainer housing 124. If $F_{WOB}$ is released such as with WOB removed, it may be possible for the rolling element 122 to have some vertical play in the retainer cavity 127, such as to wobble or move back up toward the first exposure position. However, some sort of intervention would be required, such as to restore or replace the burst disc with another burst disc or some other retention member, to retain the rolling element 122 back in the first exposure position.

Figure 6:
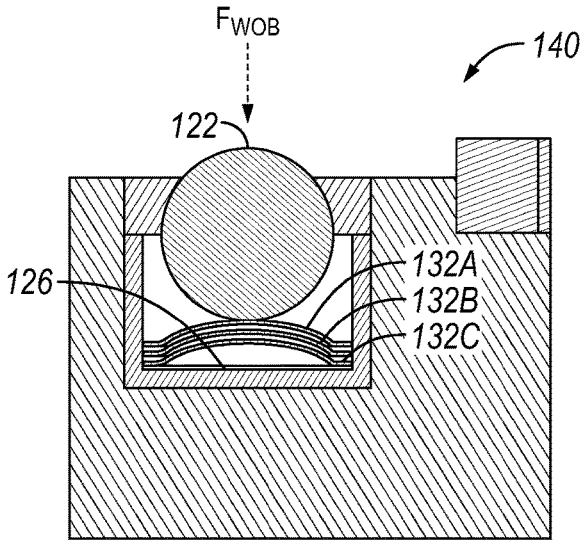
FIG. 6 is a another rolling DOCC assembly with a plurality of spaced apart retention members each comprising a burst disc.

FIG. 6 is a another rolling DOCC assembly 140 with a plurality of spaced apart retention members each comprising a burst disc. By way of example, the plurality of burst discs include first, second, and third burst discs individually designated at 132A, 132B, 132C, although a different number of burst discs could be included in other embodiments. A spacing between the burst discs 132A, 132B, 132C is exaggerated for clarity in the figure, and could be spaced/positioned so the rolling element 122 still sticks out at least slightly after 132A and 132B have burst. The burst discs 132A, 132B, 132C are vertically arranged one above the other, with a gap between adjacent burst discs 132A/132B and 132B/132C and between the third burst disc 132C and the floor 126. The rolling element 122 is initially retained in a first exposure position by the first burst disc 132A. The burst disc 132 may be rated to burst at a specified loading, such as if the weight on bit loading ($F_{WOB}$) reaches a first threshold. The rolling element may next be retained in a second exposure position by the second burst disc 132B until the second rupture disc 132B bursts, and then in a third exposure position by the third burst disc 132C until the third burst disc 132C bursts.

The burst discs may be selected to have the desired burst rating for each. The burst ratings may be the same or different. In one example, each burst disc has the same burst rating, but fails at different (e.g., progressively larger) loading $F_{WOB}$ due to the increased engagement of the fixed cutter 116 (and associated WOB required) at the successive exposure positions of the rolling element 122. In another example, the burst ratings of the burst discs 132A, 132B, 132C may be progressively larger.

Each movement of the rolling element 122 from one exposure position to the next upon bursting of the respective burst disc may be one-way. For example, the rolling element 122 changes exposure position upon bursting of the first burst disc 132A, again upon bursting of the second burst disc 132B, and again upon bursting of the third burst disc 132C. After each change in exposure position, the rolling element 122 is not biased back toward the previous exposure position in a way that would again reduce engagement of the fixed cutter 116. Similarly, the overall movement from the first exposure position (all burst discs intact) to when the rolling element 122 bottoms out on the floor 126 (all burst discs failed) is also considered one-way.

Figure 7:
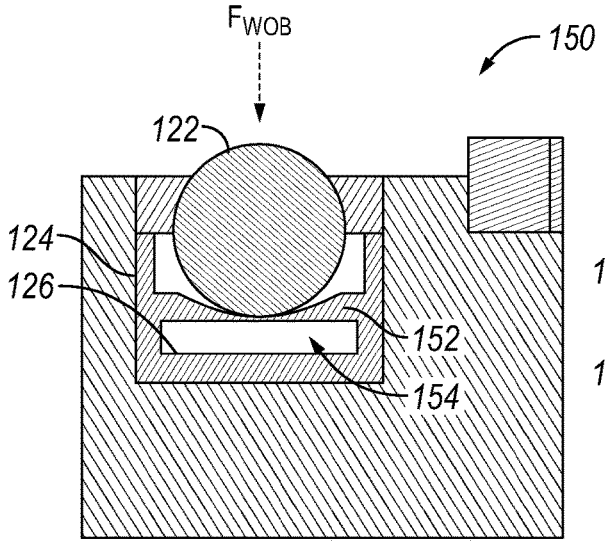
FIG. 7 is a rolling DOCC assembly wherein the rolling element is initially retained in the first exposure position by a retention member comprising a shelf.

FIG. 7 is a rolling DOCC assembly 150 wherein the rolling element 122 is initially retained in the first exposure position by a retention member comprising a shelf 152. The rolling element 122, in at least the first exposure position, limits a depth of cut of at least one fixed cutter 116. The shelf 152 may be incorporated into the retainer housing 124 beneath the rolling element 122, creating a gap between the shelf 152 and the floor 126. For example, the shelf 152 may be welded, brazed, or bonded to an interior of the retainer housing 124. Alternatively, the retainer housing 124 and shelf 152 may be integrally formed, such as using additive manufacturing (i.e., 3D printing).

The shelf 152 is configured to yield at a specified loading, such as if the weight on bit loading ($F_{WOB}$) reaches a threshold. The shelf 152 in this configuration comprises a yield zone 154 contacted by the rolling element 122. The yield zone 154 may comprise a tapered or otherwise thinned portion of the shelf 152 that is thinner than the shelf 152 is at the periphery where it is coupled to the retainer housing 124. Thus, the yield zone 154 may preferentially yield while a periphery of the shelf 152 remains intact. The yield zone 154 may be sufficiently strong to retain the rolling element 122 in the first exposure position up until the specified loading, at which point the yield zone 154 may yield or otherwise fail, allowing the rolling element 122 to move down to the second exposure position. This movement may be one-way, as was described in reference to the prior embodiments of FIGS. 5 and 6.

Figure 8:
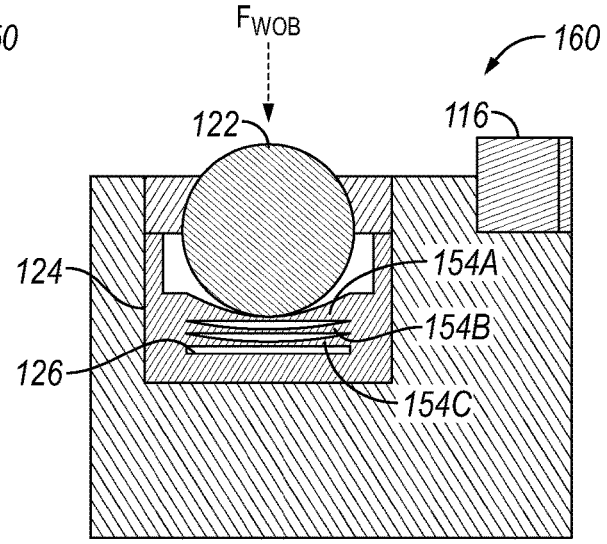
FIG. 8 is another rolling DOCC assembly with a plurality of spaced apart shelves.

FIG. 8 is another rolling DOCC assembly 160 with a plurality of spaced apart shelves, similar in some respects to the spaced apart shelves of FIG. 6. By way of example, the plurality of shelves include first, second, and third shelves individually designated at 154A, 154B, 154C, although a different number of shelves could be included in other embodiments. The shelves 154A, 154B, 154C, similar to the burst discs of FIG. 6, are vertically arranged one above the other, with a gap between adjacent shelves 154A/154B, 154B/154C and between the third shelf 154B and the floor 126 of the retainer housing 124. The rolling element 122 is initially retained in a first exposure position by the first shelf 154A. Each shelf may be rated to yield at a specified loading, such as if the weight on bit loading ($F_{WOB}$) reaches a first threshold. The rolling element may next be retained in a second exposure position by the second shelf 154B until the second shelf 154B yields, and then in a third exposure position by the third shelf 154C until the third shelf 154C yields.

The shelves may be selected to have the desired yield rating for each. The yield ratings may be the same or different. In one example, each shelf has the same yield rating, but fails at different (e.g., progressively larger) loading $F_{WOB}$ due to the increased engagement of the fixed cutter 116 (and associated WOB required) at the successive exposure positions of the rolling element 122. In another example, the yield ratings of the shelves 152A, 152B, 152C may be progressively larger.

As with the configuration of FIG. 6, the movement of the rolling element 122 in FIG. 8 from one exposure position to the next upon yielding of the respective shelf may be one-way. For example, the rolling element 122 changes exposure position upon yielding of the first shelf 152A, again upon yielding of the second shelf 152B, and again upon yielding of the third shelf 152C. After each change in exposure position, the rolling element 122 is not biased back toward the previous exposure position in a way that would again reduce exposure of the fixed cutter 116 back to the prior exposure position, at least without intervention. Similarly, the overall movement from the first exposure position (all shelves intact) to when the rolling element 122 bottoms out on the floor 126 (all shelves failed) is also considered one-way.

Figure 9:
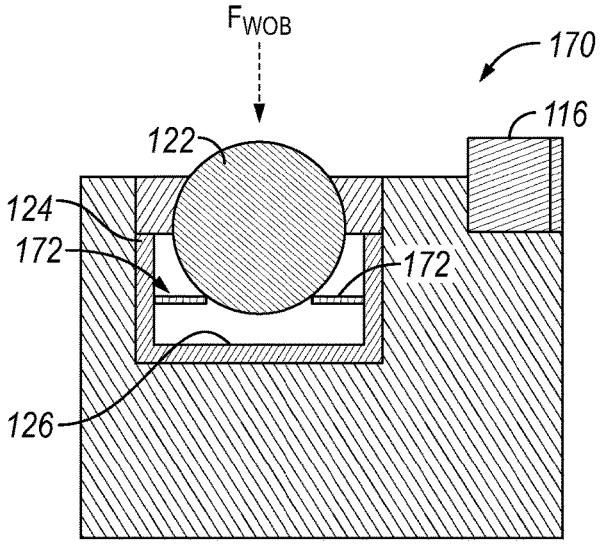
FIG. 9 is another rolling DOCC assembly wherein the rolling element is initially retained in the first exposure position by a retention member comprising a set of one or more shear pins.

FIG. 9 is another rolling DOCC assembly 170 wherein the rolling element 122 is initially retained in the first exposure position by a retention member comprising a set of one or more shear pins 172. The rolling element 122, in at least the first exposure position, limits a depth of cut of at least one fixed cutter 116. The shear pins 172 may be incorporated into the retainer housing 124 beneath the rolling element 122, creating a gap between the shear pins 172 and the floor 126. For example, the shear pins 172 may be welded, brazed, or bonded to an interior of the retainer housing 124. Alternatively, the retainer housing 124 and shear pins 172 may be integrally formed, such as using additive manufacturing (i.e., 3D printing). The shear pins 172 may comprise one or more pairs of opposing shear pins, which may be at the same height relative to the floor 126 of the retainer housing 124. The shear pins 172 may be spaced apart around a periphery of the retainer housing 124 to uniformly support the rolling element 122. In the illustrated example, the rolling element 122 sits directly on the shear pins 172, but alternatively, the retention member could comprise a shelf or other member supported by the shear pins 172 with the rolling element 122 contact the shelf or other member.

The shear pins 172 are configured to fail, typically by shearing and/or yielding at a specified loading, such as if the weight on bit loading ($F_{WOB}$) reaches a threshold. The shear pins 172 may be sufficiently strong to retain the rolling element 122 in the first exposure position up until the specified loading, at which point the shear pins 172 shear, yield, or otherwise fail, allowing the rolling element 122 to move down to the second exposure position. This movement may be one-way, as was described in reference to prior embodiments.

Figure 10:
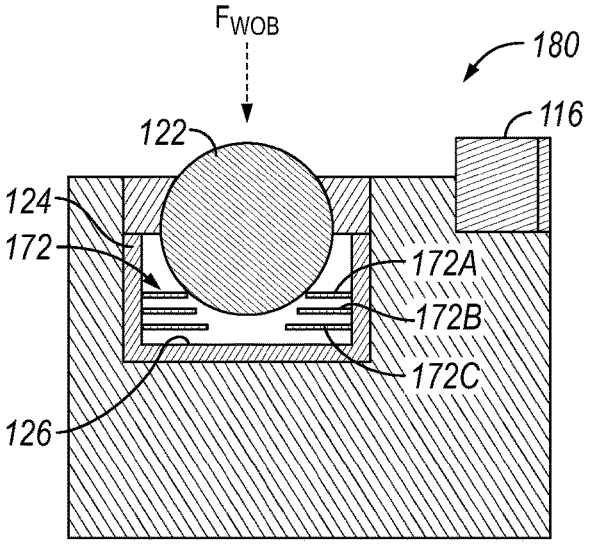
FIG. 10 is another rolling DOCC assembly with a plurality of spaced apart levels of shear pins.

FIG. 10 is another rolling DOCC assembly 180 with a plurality of spaced apart levels of shear pins, similar in some respects to the spaced apart burst discs of FIG. 6 and spaced apart shelves of FIG. 8. By way of example, the plurality of levels of shear pins 172 include first, second, and third levels of shear pins individually designated at 172A, 172B, 172C, although a different number of levels of shear pins could be included in other embodiments. The levels of shear pins 172 are vertically arranged one above the other, with a gap between adjacent levels of shear pins 172A/172B, 172B/172C and between the third level of shear pins 172C and the floor 126 of the retainer housing 124. The rolling element 122 is initially retained in a first exposure position by the first level of shear pins 172A. The first level of shear pins 172A may be rated to fail at a specified loading, such as if the weight on bit loading ($F_{WOB}$) reaches a first threshold. The rolling element may next be retained in a second exposure position by the second level of shear pins 172B until the second level of shear pins 172B yields, and then in a third exposure position by the third level of shear pins 172C until the third level of shear pins 172C yields.

The levels of shear pins may be selected to have the desired failure rating for each. The failure ratings may be the same or different. In one example, each level of shear pins has the same failure rating, but fails at different (e.g., progressively larger) loading $F_{WOB}$ due to the increased engagement of the fixed cutter 116 (and associated WOB required) at the successive exposure positions of the rolling element 122. In another example, the failure ratings of the levels of shear pins 172A, 172B, 172C may be progressively larger.

As with other configurations, the movement of the rolling element 122 in FIG. 10 from one exposure position to the next upon failure of the respective level of shear pins may be one-way. For example, the rolling element 122 changes exposure position upon failure of the first level of shear pins 172A, again upon failure of the second level of shear pins 172B, and again upon failure of the third level of shear pins 172C. After each change in exposure position, the rolling element 122 is not biased back toward the previous exposure position in a way that would again reduce engagement of the fixed cutter 116 back to the prior exposure position, at least without intervention. Similarly, the overall movement from the first exposure position (all levels of shear pins intact) to when the rolling element 122 bottoms out on the floor 126 (all levels of shear pins failed) is also considered one-way.

In another embodiment, a shape memory material could be used as a retainer element. Instead of failing or yielding like the burst discs, shelves, or pins, the shape memory material could change shape in response to a change in temperature. For example, a retainer element may be formed having an arched shape, similar to the example shape of burst discs above, except that the arched shape may increase with temperature. Even if the shape change is reversible by reducing temperature (e.g., when removing the drill bit from the well), the movement of the retainer element in response to temperature may still be considered one-way in the context of drilling, since temperature increases with depth.

Figure 11:
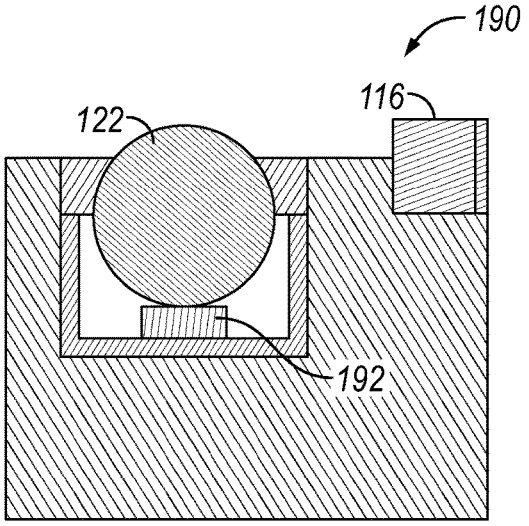
FIG. 11 is another rolling DOCC assembly wherein the rolling element is initially retained in the first exposure position by a retention member comprising a shape memory material member at a first temperature.

FIG. 11 is another rolling DOCC assembly 190 wherein the rolling element 122 is initially retained in the first exposure position by a retention member comprising a shape memory material member 192. The rolling element 122, in at least the first exposure position, limits a depth of cut of at least one fixed cutter 116. The shape memory material member 192 may initially support the rolling element 122 at the first exposure position. The shape memory material member 192 comprises a shape memory material configured to change shape to release the DOCC element downhole in response to a temperature change.

Figure 12:
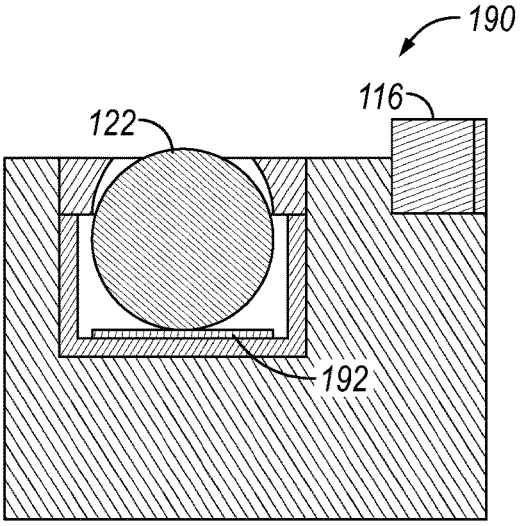
FIG. 12 is the rolling DOCC assembly of FIG. 11 after the shape memory material member has re-formed at a second temperature, thereby releasing the rolling element from the first exposure position of FIG. 11 to a second exposure position as shown in FIG. 12.

FIG. 12 is the rolling DOCC assembly 190 of FIG. 11 after the shape memory material member 192 has changed shape in response to a temperature change downhole, thereby releasing the rolling element 122 from the first exposure position of FIG. 11 to a second exposure position as shown in FIG. 12. The second exposure position further exposes the fixed cutter 116 to the formation being cut. The movement from the first exposure position to second exposure position may be one-way (e.g., for one-time deactivation of the rolling element 122) in that the shape memory material presumably remains in the changed shape state while it remains at or above the downhole temperature at which it changed shape.

Figure 13:
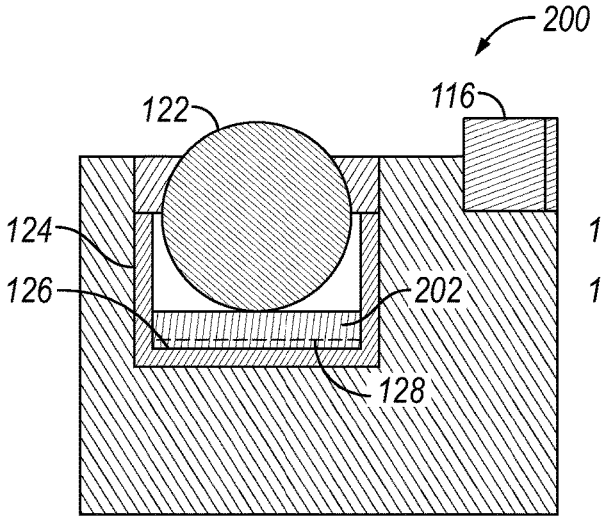
FIG. 13 is another rolling DOCC assembly in which the rolling element is supported on a retention member comprising a bearing formed of a wearable material.

FIG. 13 is another rolling DOCC assembly 200 in which the rolling element 122 is supported on a retention member (e.g., a bearing) 202 formed of a disintegrating material. The retention member 202 may disintegrate such as by wearing, eroding, melting, dissolving, or a combination thereof. The rolling element 122, in at least the first exposure position, limits a depth of cut of at least one fixed cutter 116. The retention member 202 may be secured within the retainer housing 124, such as by welding, brazing, or bonding, or it may be integrally formed with the retainer housing 124. The rolling element 122 is typically made from a relatively hard and wear-resistant material, such as diamond or tungsten carbide. The retention member 202 could be made of a structural material with sufficient mechanical properties to initially retain the rolling element 122 in the first exposure position. The structural material of the retention member 202 may be softer or less wear-resistant than the rolling element 122, so that the retention member 202 preferentially wears as the rolling element 122 rolls against the retention member 202 under a drilling load, or in response to an abrasive fluid, a melting temperature, a solvent, or other agent that will promote disintegration. As the retention member 202 disintegrates, the exposure of the roller is thereby reduced. Optionally, a wear-resistant (e.g., hardened) insert 128 could be disposed on the floor 126 of the retainer housing 124 and/or the retainer housing 124 or at least the floor 126 of the retainer housing 124 could be formed of a wear-resistant material.

Figure 14:
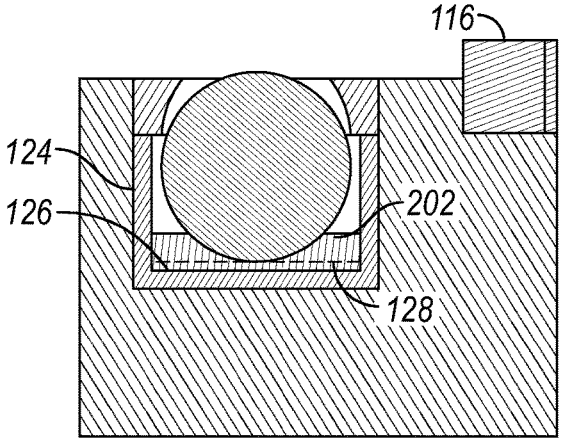
FIG. 14 is the rolling DOCC assembly of FIG. 13 after the bearing has worn down, gradually allowing the rolling element to move from the first exposure position of FIG. 13 to a second exposure position of FIG. 14.

FIG. 14 is the rolling DOCC assembly 200 of FIG. 13 after the retention member 202 has worn down or otherwise disintegrated, gradually allowing the rolling element 122 to move from the first exposure position of FIG. 13 to a second exposure position of FIG. 14. The wearable portion of the retention member 202 may be specifically configured with a wear or disintegration rate selected to allow the drill bit to drill to a target depth. For example, the target depth may be at least approximately the depth from surface to the start of a lateral wellbore, at which point an increased engagement is desired for the fixed cutters 116. The optional hardened insert 128 or the hardened floor 126 may resist further wear so that the rolling element 122 is retained in the second exposure position with continued drilling after the rolling element 122 has reached the second exposure position of FIG. 14.

Figure 15:
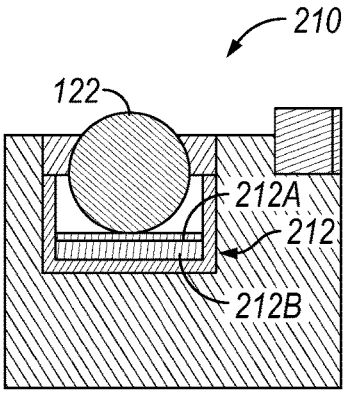
FIG. 15 is another rolling DOCC assembly with a retention member comprising a bearing element with variable wear properties.

FIG. 15 is another rolling DOCC assembly 210 with a retention member comprising a bearing element 212 with variable wear (or other variable disintegrating) properties. The rolling element 122, in at least the first exposure position, limits a depth of cut of at least one fixed cutter 116. By way of example, the bearing element 212 includes a relatively hard upper layer 212A and a relatively soft (or otherwise more easily disintegrated) lower layer 212B. The wear/disintegration rate of the upper layer 212A by contact with the rolling element 122 is therefore reduced as compared with the lower layer 212B under the same loading conditions. The rolling element 122 is therefore supported by the upper layer 212A with relatively low rate of change in exposure height over a specified drilling depth. The upper layer 212A may be configured, such as by selection of material and thickness, to withstand a certain initial depth of drilling a wellbore.

Figure 16:
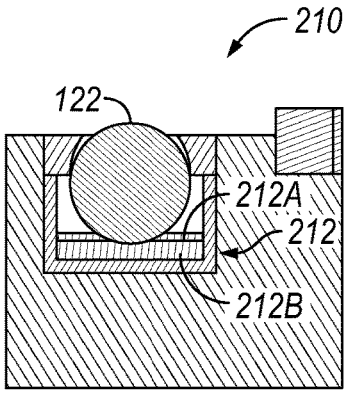
FIG. 16 is the rolling DOCC assembly of FIG. 15 after the rolling element has worn through the upper layer of the bearing element and has made initial contact with the lower layer.

FIG. 16 is the rolling DOCC assembly 210 of FIG. 15 after the rolling element 122 has worn through the upper layer 212A of the bearing element 212 and has made initial contact with the lower layer 212B.

Figure 17:
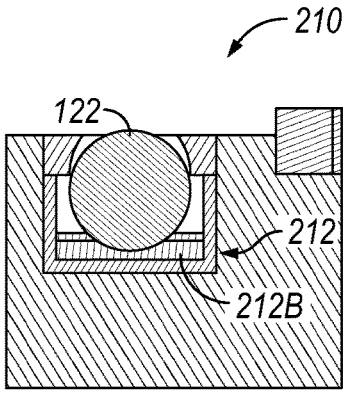
FIG. 17 is the rolling DOCC assembly of FIGS. 15 and 16 after the rolling element has worn most of the way through the lower layer of the bearing element.

FIG. 17 is the rolling DOCC assembly 210 of FIGS. 15 and 16 after the rolling element 122 has worn most of the way through the lower layer 212B of the bearing element 212. The rate of change in exposure height of the rolling element from FIG. 16 to FIG. 17 per foot of drilling depth is greater in this example than the rate of change in exposure height of the rolling element from FIG. 15 to FIG. 16. However, the bearing element 212 could alternatively be configured so that the wear rate decreases over the course of drilling to a certain depth. In other embodiments, rather than discrete layers of different hardness, the bearing element 212 could be formed of a hardness gradient that varies with depth. Such other bearing element configurations could be formed, for example, using additive manufacturing, such as by varying the material and/or material density with thickness of the bearing element.

Figure 18:
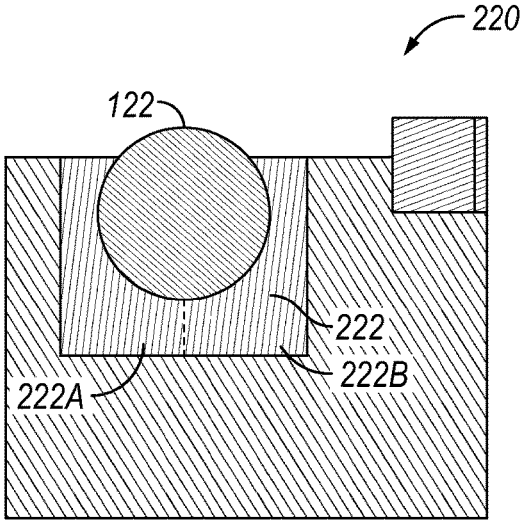
FIG. 18 is another rolling DOCC assembly with a retainer element that initially surrounds the rolling element.

FIG. 18 is another rolling DOCC assembly 220 with a retainer element 222 that initially surrounds the rolling element 122. The rolling element 122, in at least the first exposure position, limits a depth of cut of at least one fixed cutter 116. The retainer element 222 may also functionally serve as the housing, and may comprise a 2 (or more) housing portions 222A, 222B that may be fixed together about the rolling element 122. In this example, the housing portions 222A, 222B are horizontally arranged on either side of the rolling element 122. Alternative arrangements (e.g. vertically arranged, upper/lower housing portions) are also within the scope of this disclosure. The rolling element 122 could alternatively be embedded in the retainer element 222 in any other suitable way during manufacturing.

Figure 19:
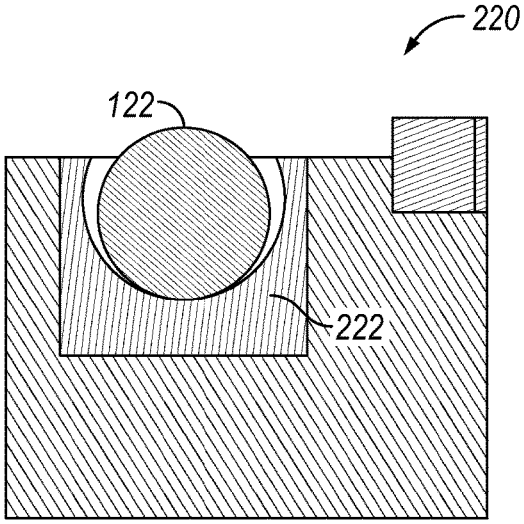
FIG. 19 is the rolling DOCC assembly of FIG. 18, wherein the retainer element has partially worn away in response to rolling contact by the rolling element.

FIG. 19 is the rolling DOCC assembly 220 of FIG. 18, wherein the retainer element 222 has partially worn away in response to rolling contact by the rolling element 122. The retainer element 222 may wear not only with depth but also laterally, as illustrated. The retainer element 222 (and retainer housing, if included) may allow lateral wearing of the retainer element 222. Any materials that are disintegrated while drilling may be circulated to surface with other cuttings.

A variety of materials may be selected for retention members designed to wear in response to rolling contact by the rolling element 122. Such materials could be softer than the rolling element, such as steel, Inconel, titanium, or another metal with the desired hardness. The material could be one of various grades of carbide with differing cobalt contents to more precisely control the krevs/footage needed to displace the rolling element. The material could be steel with a carbide coating, such as laser-deposited carbide or HVOF, to vary the rate at which the roller begins to lose exposure. The material could be a matrix or ceramic material. The thickness of the bearing element or housing wall can be varied in addition to the material to control the krevs/footage drilled before the element disengages with formation. The roller could instead be made of a softer material than the retainer, such that is wears down enough that it no longer can be held by the retainer and escapes during the run.

Foregoing embodiments provide examples of "deactivation" of the rolling element 122, whereby the rolling element 122 initially limits the engagement of the cutting element to the formation and the corresponding depth of cut, and then moves inward to increase the engagement and depth of cut. Thus, the second exposure position is inward of the first exposure position. The rolling element 122 may move far enough inward so as to not appreciably limit depth of cut in the second exposure position. This deactivation of the rolling DOCC element is considered a "one-time deactivation" if the movement is one-way.

Embodiments may also be constructed that provide "activation" of the rolling element downhole, wherein the rolling element 122 moves outwardly instead of inwardly. Thus, the second exposure position is outward of the first exposure position. By moving outwardly, the rolling element 122 limits depth of cut more in the second exposure position than in the first exposure position. This movement may also be one-way, in which case it may be considered a one-time activation of the rolling element.

Figure 20:
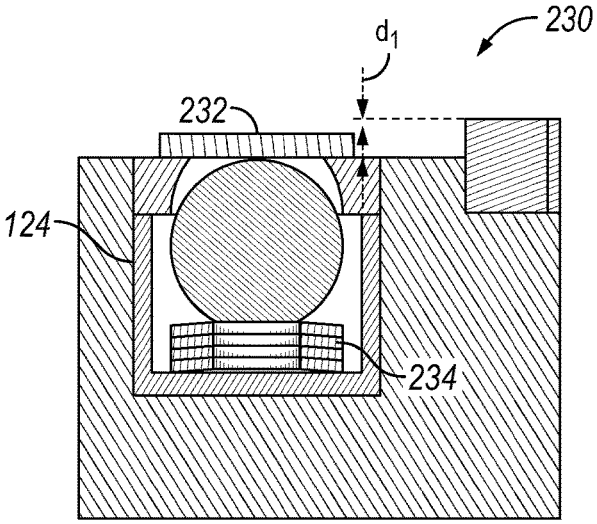
FIG. 20 is another example of a rolling DOCC assembly that provides one-time activation of the rolling element.

FIG. 20 is another example of a rolling DOCC assembly 230 that provides one-time activation of the rolling element 122. The rolling element 122 is initially captured in the retainer housing 124 by a retention member, embodied by way of example as a cap 232 on the retainer housing 124. The depth of engagement $d_1$ in this first exposure position is relatively large, such that little or no depth of cut limiting is provided by the rolling element 122. A biasing member 234, such as a spring, is disposed in the retainer housing 124 to bias the rolling element 122 outwardly. Alternatively, fluid pressure may be supplied from below the rolling element 122 to bias the rolling element 122 outwardly. The rolling element 122 is initially trapped below the cap 232 and initially retained in this first exposure position that provides little or no initial depth of cut control. The cap 232 is configured to fail or disintegrate downhole, similar to the retention members in the previous example embodiments, at which point the rolling element 122 may be urged upward by the biasing member.

Figure 21:
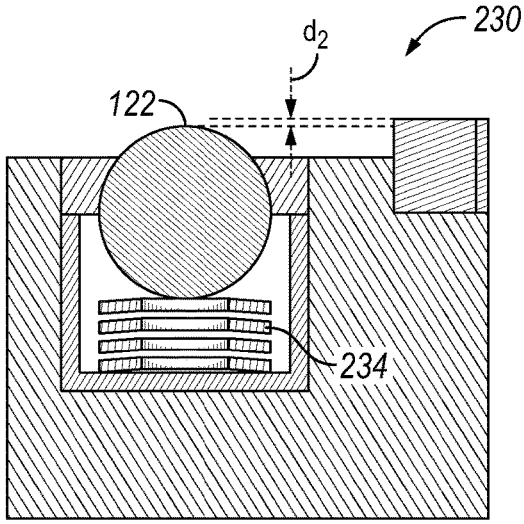
FIG. 21 is the rolling DOCC assembly of FIG. 20, wherein the cap has been removed, disintegrated, failed, or otherwise eliminated, so that the rolling element may move outwardly from the first exposure position to the second exposure position.

FIG. 21 is the rolling DOCC assembly 230 of FIG. 20, wherein the cap 232 has been removed, disintegrated, failed, or otherwise eliminated, so that the rolling element 122 may move outwardly from the first exposure position to the second exposure position. The rolling element 122 is urged outwardly by the biasing member 234 to the second exposure position, which has a correspondingly reduced depth of engagement $d_2$ of the fixed cutter 116. In that way, the rolling element 122 is now activated. The biasing member 234 may provide sufficient force in some embodiments to maintain the rolling element 122 in the second exposure position, to be considered a one-time activation of the rolling element 122.

Accordingly, the present disclosure encompasses depth of cut control assemblies for a drill bit that have moveable and optionally rolling DOCC elements to change their exposure and the corresponding engagement of cutters during drilling. Rather than moving back and forth between exposure positions, the DOCC elements in at least some embodiments are activated or deactivated once during drilling, with one-way changes in exposure. Related drill bits, drilling systems, and drilling methods incorporating the depth of cut control assemblies are also provided. Multiple embodiments are disclosed, while other embodiments may be formed from any suitable combination of the collective features of the multiple embodiments disclosed, including one or more of the following statements.

Statement 1. A drill bit comprising: a bit body securable to a drill string; a plurality of blades extending from the bit body; a plurality of fixed cutters secured to the blades; at least one depth of cut control (DOCC) element positioned in a retainer pocket along the blade to limit a depth of cut of one of the fixed cutters; and a retention member initially retaining the DOCC element within the retainer pocket at a first exposure position, the retention member configured to release the DOCC element downhole to allow one-way movement of the DOCC element to a second exposure position.

Statement 2. The drill bit of Statement 1, further comprising a one-time deactivation configuration wherein the one-way movement of the DOCC element from the first exposure position to the second exposure position increases the depth of cut allowed by the DOCC element.

Statement 3. The drill bit of Statement 1 or 2, further comprising a one-time activation configuration wherein the one-way movement of the DOCC element from the first exposure position to the second exposure position decreases the depth of cut allowed by the DOCC element.

Statement 4. The drill bit of Statement 3, further comprising: a biasing element configured for biasing the DOCC element from the first exposure position to the second exposure position in response to the release of the DOCC element by the retention member.

Statement 5. The drill bit of Statement 1, wherein the retention member is engaged by the DOCC element to release the DOCC element downhole by yielding in response to a threshold force applied to the DOCC element.

Statement 6. The drill bit of any of Statements 1 to 5, wherein the retention member comprises a disintegrating material to release the DOCC element downhole by disintegrating downhole in response to an increase in temperature or exposure to a downhole fluid.

Statement 7. The drill bit of any of Statements 1 to 6, wherein the DOCC element is rotatably secured by the retainer pocket when in one or both of the first exposure position and the second exposure position.

Statement 8. The drill bit of Statement 7, wherein the retention member comprises a wearable material to release the DOCC element to the second exposure position in response to rolling of the DOCC element against the wearable material while drilling.

Statement 9. The drill bit of Statement 8, wherein the wearable material comprises an outer layer of harder wearable material over an inner layer of softer wearable material.

Statement 10. The drill bit of any of Statements 7 to 9, wherein the DOCC element is trailing the one of the fixed cutters.

Statement 11. The drill bit of any of Statements 7 to 10, further comprising: a main cutting structure comprising a plurality of fixed cutters secured along the blades; and wherein the DOCC element is configured for cutting as part of the main cutting structure in at least the first exposure position.

Statement 12. The drill bit of any of Statements 1 to 11, wherein the retention member comprises a shape memory material configured to release the DOCC element downhole by changing shape in response to reaching a threshold temperature.

Statement 13. The drill bit of any of Statements 1 to 12, wherein the retention member comprises a shear member configured to shear in response to a threshold force or a burst disc configured to burst in response to a threshold pressure.

Statement 14. A method, comprising: drilling a wellbore by engaging an earthen formation with a drill bit comprising a plurality of fixed cutters secured to blades extending from a bit body, by rotating the bit body around a bit axis to cut the earthen formation with the plurality of fixed cutters; limiting a depth of cut of at least one of the fixed cutters by engaging the formation with a depth of cut control (DOCC) element spaced from the one of the fixed cutters while initially retaining the DOCC element at a first exposure position; and releasing the DOCC element downhole to move the DOCC element to a second exposure position.

Statement 15. The method of Statement 14, further comprising a one-time deactivation wherein moving the DOCC element from the first exposure position to the second exposure position comprises increasing the depth of cut allowed by the DOCC element.

Statement 16. The method of Statement 14 or 15, further comprising a one-time activation wherein moving the DOCC element from the first exposure position to the second exposure position comprises decreasing the depth of cut allowed by the DOCC element.

Statement 17. The method of any of Statements 14 to 16, further comprising: rotating the DOCC element relative to the bit body while rotating the drill bit around the bit axis in one or both of the first exposure position and the second exposure position.

Statement 18. The method of Statement 17, further comprising: rolling the DOCC element against an outer layer of wearable material to wear though the outer layer of wearable material to an inner layer of wearable material while drilling a first portion of the wellbore; and rolling the DOCC element against the inner layer of wearable material while drilling a second portion of the wellbore.

Statement 19. The method of any of Statements 14 to 18, further comprising: cutting the formation with the DOCC element along with the plurality of fixed cutters while the DOCC element is in the first exposure position; and using the DOCC element to limit the depth of cut of the one of the fixed cutters after moving the DOCC element to the second exposure position.

Statement 20. A drilling system, comprising: a drill string; a drill bit comprising a bit body secured to a lower end of the drill string and rotatable about a bit axis, the drill bit including a plurality of blades extending from the bit body, a plurality of fixed cutters secured to the blades, and a plurality of depth of cut control (DOCC) elements positioned in respective retainer pockets along the blades to limit a depth of cut of the fixed cutters; and a retention member initially retaining each DOCC element within the respective retainer pocket at a first exposure position, the retention member configured to release the DOCC element after drilling to a depth downhole to allow one-way movement of the DOCC element to a second exposure position.

To facilitate a better understanding of the present invention, the following examples of certain aspects of some embodiments are given. In no way should the following examples be read to limit, or define, the entire scope of the disclosure.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A drill bit comprising:

a bit body securable to a drill string;

a plurality of blades extending from the bit body;

a plurality of fixed cutters secured to the blades;

at least one depth of cut control (DOCC) element positioned in a retainer pocket along the blade to limit a depth of cut of one of the fixed cutters; and a retention member initially retaining the DOCC element within the retainer pocket at a first exposure position, the retention member configured to fail or disintegrate to release the DOCC element from an activated state at the first exposure position to a deactivated state at a second exposure position.

2. The drill bit of claim 1, wherein movement of the DOCC element from the first exposure position to the second exposure position increases the depth of cut allowed by the DOCC element.

3. The drill bit of claim 1, further comprising:

a biasing element configured for biasing the DOCC element from the first exposure position to the second exposure position in response to the release of the DOCC element by the retention member.

4. The drill bit of claim 1, wherein the retention member is configured to fail or disintegrate to release the DOCC element in response to the DOCC element applying a threshold force to the retention member.

5. The drill bit of claim 1, wherein the retention member comprises a disintegrating material to release the DOCC element downhole by disintegrating downhole in response to an increase in temperature or exposure to a downhole fluid.

6. The drill bit of claim 1, wherein the DOCC element is rotatably secured by the retainer pocket in the first exposure position and/or the second exposure position.

7. The drill bit of claim 1, wherein the DOCC element is trailing the one of the fixed cutters.

8. The drill bit of claim 1, wherein the retention member comprises a shear member configured to fail or disintegrate via shearing in response to a threshold force being applied to the shear member.

9. The drill bit of claim 1, wherein the retention member comprises a burst disc configured to fail or disintegrate via bursting in response to a threshold pressure being applied to the burst disc.

10. A drill bit comprising:

a bit body securable to a drill string;

a plurality of blades extending from the bit body;

a plurality of fixed cutters secured to the blades;

at least one depth of cut control (DOCC) element positioned in a retainer pocket along the blade to limit a depth of cut of one of the fixed cutters; and a retention member initially retaining the DOCC element within the retainer pocket at a first exposure position, the retention member configured to release the DOCC element from an activated state at the first exposure position to a deactivated state at a second exposure position, and wherein the retention member comprises a wearable material to release the DOCC element to the second exposure position in response to rolling of the DOCC element against the wearable material while drilling.

11. The drill bit of claim 10, wherein the wearable material comprises an outer layer of harder wearable material over an inner layer of softer wearable material.

12. The drill bit of claim 10, wherein the DOCC element is rotatably secured by the retainer pocket in the first exposure position and/or the second exposure position.

13. The drill bit of claim 10, wherein movement of the DOCC element from the first exposure position to the second exposure position increases the depth of cut allowed by the DOCC element.

14. A method, comprising:

drilling a wellbore by engaging an earthen formation with a drill bit, the drill bit comprising a plurality of fixed cutters secured to blades extending from a bit body, by rotating the drill bit around a bit axis to cut the earthen formation with the plurality of fixed cutters;

limiting a depth of cut of at least one of the fixed cutters by engaging the formation with a depth of cut control (DOCC) element retained at a first exposure position in an activated state via a retention member, wherein the DOCC element is spaced from the one of the fixed cutters; and releasing the DOCC element, via failure or disintegration of the retention member, from the activated state at the first exposure position to a deactivated state at a second exposure position.

15. The method of claim 14, further comprising a one-time deactivation wherein moving the DOCC element from the first exposure position to the second exposure position comprises increasing the depth of cut allowed by the DOCC element.

16. The method of claim 14, further comprising a one-time activation wherein moving the DOCC element from the first exposure position to the second exposure position comprises decreasing the depth of cut allowed by the DOCC element.

17. The method of claim 14, further comprising:

rolling the DOCC element relative to the bit body while rotating the drill bit around the bit axis in one or both of the first exposure position and the second exposure position.

18. A method, comprising:

drilling a wellbore by engaging an earthen formation with a drill bit, the drill bit comprising a plurality of fixed cutters secured to blades extending from a bit body, by rotating the drill bit around a bit axis to cut the earthen formation with the plurality of fixed cutters;

limiting a depth of cut of at least one of the fixed cutters by engaging the formation with a depth of cut control (DOCC) element spaced from the one of the fixed cutters while initially retaining the DOCC element at a first exposure position; and releasing the DOCC element to move the DOCC element to a second exposure position; wherein releasing the DOCC element includes rolling the DOCC element against an outer layer of wearable material to wear though the outer layer of wearable material to an inner layer of wearable material while drilling a first portion of the wellbore and rolling the DOCC element against the inner layer of wearable material while drilling a second portion of the wellbore, and wherein the DOCC element is configured to roll relative to the bit body in response to rotation of the drill bit around the bit axis.

19. A drilling system, comprising:

a drill string;

a drill bit comprising a bit body secured to a lower end of the drill string and rotatable about a bit axis, the drill bit including a plurality of blades extending from the bit body, a plurality of fixed cutters secured to the blades, and a plurality of depth of cut control (DOCC) elements positioned in respective retainer pockets along the blades to limit a depth of cut of the fixed cutters; and a retention member initially retaining each DOCC element within the respective retainer pocket at a first exposure position, the retention member configured to fail or disintegrate to release the DOCC element from an activated state at the first exposure position to a deactivated state at a second exposure position after drilling to a depth downhole, wherein the retention member is disposed between the DOCC element and a floor of the respective retainer pocket in the first exposure position, and wherein the DOCC directly contacts the floor in the second exposure position.

* * * * *